US005937456A

United States Patent [19]

Norris

[11] Patent Number: 5,937,456

[45] Date of Patent: Aug. 17, 1999

[54] DEVICE FOR TRANSFERRING A PATIENT TO AND FROM A HOSPITAL BED

[76] Inventor: John F. Norris, 630 Commercial St., Braintree, Mass. 02189

[21] Appl. No.: 08/920,939

[22] Filed: Aug. 29, 1997

[51] Int. Cl.[6] ..... A61G 7/10

[52] U.S. Cl. ..... 5/88.1; 5/81.1 R

[58] Field of Search ..... 5/88.1, 86.1, 81.1 R, 5/85.1, 81.1 C

[56] References Cited

U.S. PATENT DOCUMENTS

| | | | |
|---|---|---|---|
| 2,528,048 | 10/1950 | Gilleland | 5/86.1 |
| 2,536,707 | 1/1951 | Allyn | 5/85.1 |
| 4,077,073 | 3/1978 | Koll et al. | 5/81.1 C |
| 4,087,873 | 5/1978 | Ohkawa | 5/81.1 C |
| 4,776,047 | 10/1988 | DiMatteo | 5/88.1 |
| 4,914,769 | 4/1990 | Kume et al. | 5/81.1 C |
| 5,048,133 | 9/1991 | Iura et al. | 5/81.1 C |
| 5,163,189 | 11/1992 | De Gray | 5/86.1 |
| 5,185,894 | 2/1993 | Bastert et al. | 5/81.1 C |
| 5,540,321 | 7/1996 | Foster | 5/81.1 R |

FOREIGN PATENT DOCUMENTS

| | | | |
|---|---|---|---|
| 1090388 | 5/1984 | U.S.S.R. | 5/81.1 C |
| 7001030 | 2/1987 | WIPO | 5/81.1 C |

*Primary Examiner*—Alex Grosz

*Attorney, Agent, or Firm*—Steven N. Fox, Esq.

[57] ABSTRACT

Disclosed is a device useable for by a technician to transport a patient to and from a hospital bed. In one embodiment, the device comprises: a support frame comprising a plurality of wheels adapted to roll upon the floor. The device further comprises a patient transfer portion engaged with and extending outward of the support frame and comprising a plurality of belts. The device further comprises a patient transport portion engaged with the support frame and comprising a plurality of belts. The device further comprises a drive wheel engaged with the support frame. The device further comprises a drive mechanism engaged with the support frame. The drive mechanism comprising a manual crank wheel and is adapted such that rotation of the manual crank wheel by the person causes the drive wheel to rotate and to move the support frame in a first direction and at a first velocity and to move the belts of the patient transfer portion and the patient transport portion in a second direction and at a second velocity. The first direction is substantially opposite to the second direction, while the first velocity and the second velocity are substantially the same. Upon engagement of the drive wheel and rotation of the manual crank wheel by the person the patient transfer portion may be moved under the patient and upon disengagement of the drive wheel and rotation of the manual crank wheel the patient is moved from the patient transfer portion to the patient transport portion.

16 Claims, 7 Drawing Sheets

DEVICE FOR TRANSFERRING A PATIENT TO AND FROM A HOSPITAL BED

FIELD OF THE INVENTION

The present invention relates generally to devices for transporting medical patients. More specifically, the pent invention relates to devices for transforming patients into and out of a bed.

BACKGROUND OF THE INVENTION

In hospitals, there is a frequent need to transfer a patient from a hospital bed to different areas of the hospital such as surgery or x-ray examination rooms. Typically, nurses or other hospital personnel such as orderlies physically move the patient from the hospital bed to a icy which is then rolled to the desired area of the hospital. When the gurney carrying the patient arrives at the desired section of the hospital, the technician once again, physically moves the patient onto another hospital or examination bed. The act of physically moving the patients cab be dangerous to both the patient as well as the technician; patients who are injured may become further injured by an the force applied by the technician to move the patient. Similarly, a technician may strain herself while attempting to move or support a heavy patient.

The principal object of the present invention is to provide a device for moving a patient from one hospital bed to a second hospital bed without requiring hospital personnel and/or the patient to exert any force during the transfer.

SUMMARY OF THE PRESENT INVENTION

Disclosed is a device for by a technician to transport a patient to and from a hospital bed. In one embodiment, the device A device for use by a person to transport a patient from a hospital bed, the device comprises: a support frame comprising a plurality of wheels adapted to roll upon the floor. The device further comprises a patient transfer portion engaged with and extending outward of the support frame and comprising a plurality of belts. The device further comprises a patient transport portion engaged with the support frame and comprising a plurality of belts. The device further comprises a drive wheel engaged with the support frame. The device further comprises a drive mechanism engaged with the support frame. The drive mechanism comprising a manual crank wheel and is adapted such that rotation of the manual crank wheel by the person causes the drive wheel to rotate and to move the support frame in a first direction and at a first velocity and to move the belts of the patient transfer portion and the patient transport portion in a second direction and at a second velocity. The first direction is substantially opposite to the second direction, while the first velocity and the second velocity are substantially the same. Upon engagement of the drive wheel and rotation of the manual crank wheel by the person the patient transfer portion may be moved under the patient and upon disengagement of the drive wheel and rotation of the manual crank wheel the patient is moved from the patient transfer portion to the patient transport portion. Throughout the transfer process, the patient is never slid, lifted or otherwise physically invaded, thereby reducing any injury to the patient and/or to the person transferring the patient to and/or from a hospital bed.

BRIEF DESCRIPTION OF THE DRAWINGS

The following detailed description of the invention will be better understood with reference to the accompanying drawings in which.

DETAILED DESCRIPTION OF THE PREFERRED EMBODIMENTS

Figure 1:
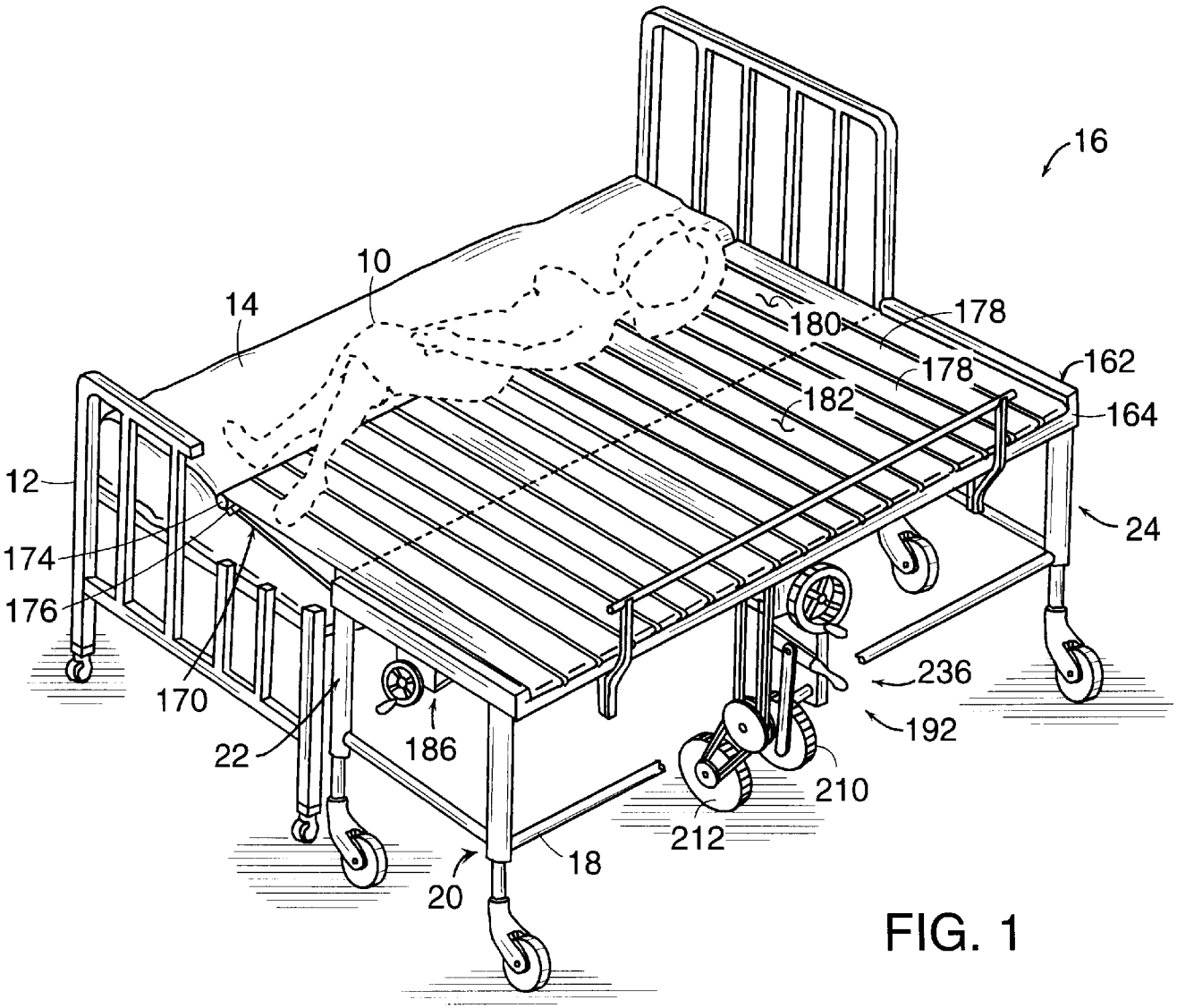
FIGS. 1 and 2 are perspective views of a first embodiment of the patient transportation device of the present invention.
Figure 2:
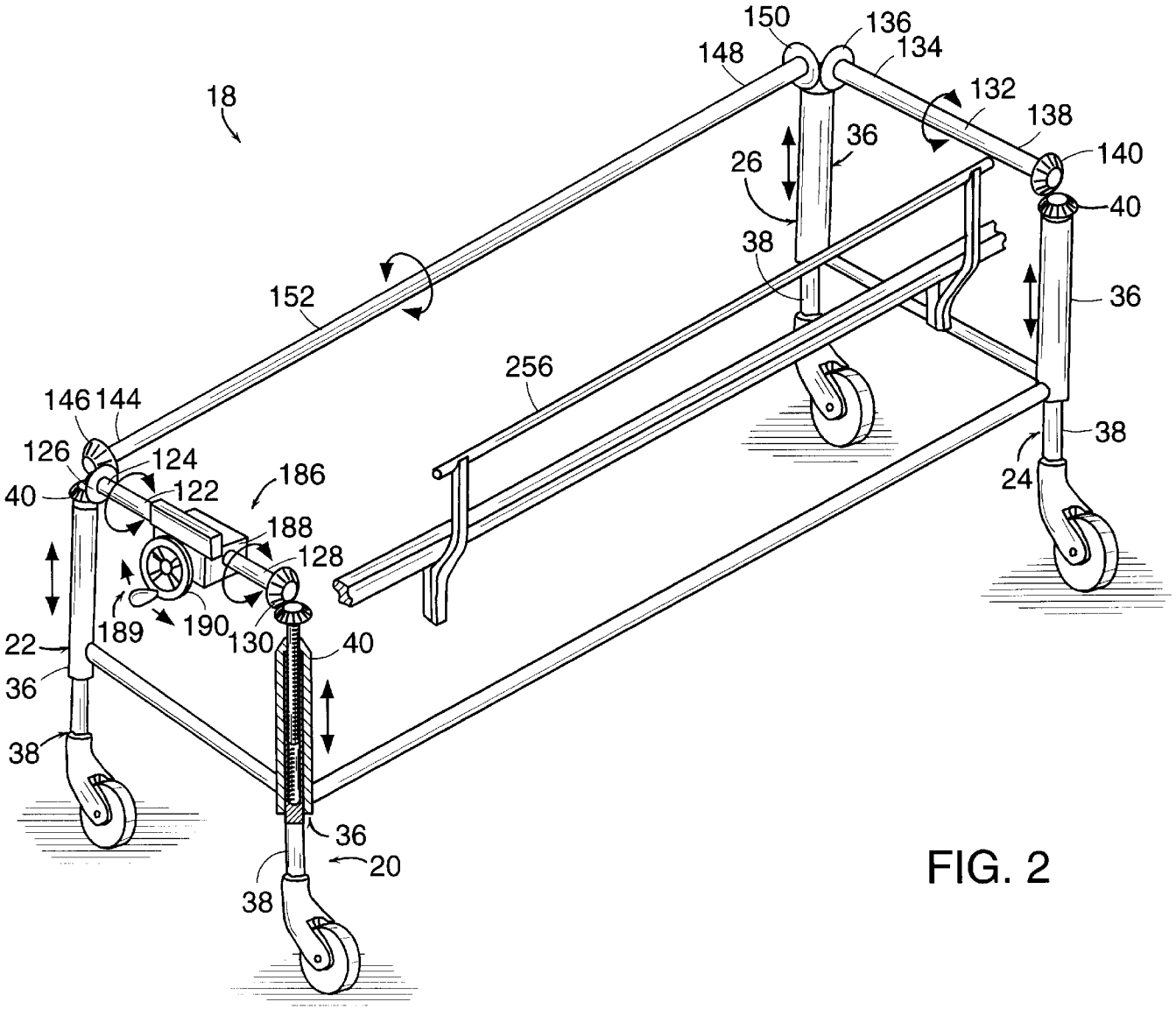

Referring to FIGS. 1 and 2, wherein a patient 10 is shown disposed upon a conventional hospital bed 12 having a cushion 14.

The patient transportation device 16 comprises a lower support frame 18 having a first leg assembly 20, a second leg assembly 22, a third leg assembly 24, and a fourth leg assembly 26. The support frame assembly 18 further comprises a first end rotational support 122, a second end rotational support 132, and a side rotational support 152.

Figure 7:
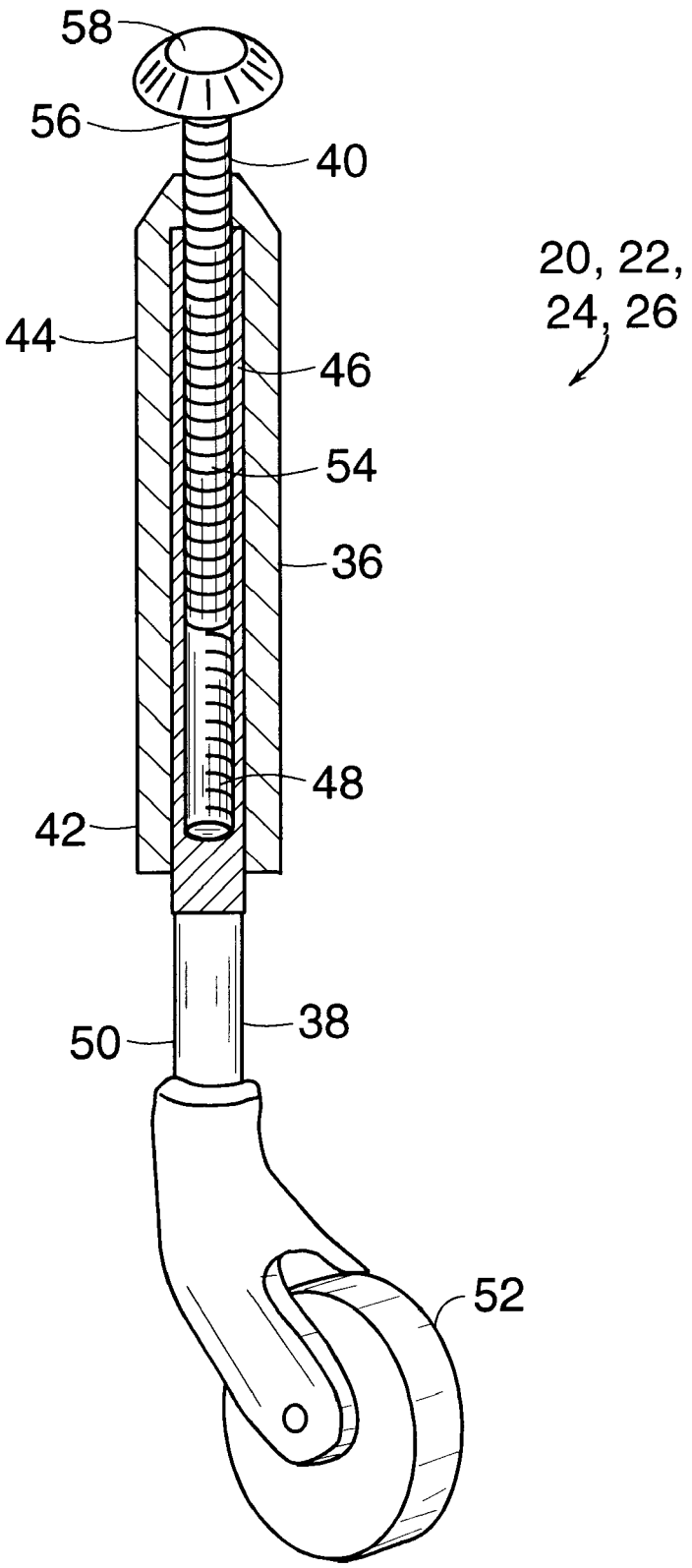
FIG. 7 is a cross section view taken along line 7—7 of FIG. 2.

As shown by FIG. 7, each of the leg assemblies 20, 22, 24 and 26 comprise an elongated cylinder 36, a wheel member 38 and a male screw drive member 40. The elongated cylinder 36 comprises a first end 42 and a second end 44 having internal threads 46. The wheel member 38 comprises a first end portion 48 engaged with the first end portion 42 of the elongated cylinder 36 and a second end portion 50 having a caster wheel 52 connected thereto. The male screw drive member 40 comprise a first end portion 54 rotatably engaged with the second end portion 46 of the elongated cylinder 36 and a second end portion 56 having a translation gear 58 connected thereto.

The first end upper rotational support 122 comprises a first end 124 having a translation gear 126 engaged with translation gear 58 of second leg assembly 24 and a second end 128 having a translation gear 130 engaged with translation gear 58 of first leg assembly 20.

The second end upper rotational support 132 comprises a first end 134 having a translation gear 136 engaged with translation gear 58 of third leg assembly 24 and a second end 138 having a translation gear 140 engaged with translation gear 58 of fourth leg assembly 26.

The side upper rotational support 152 comprises a first end 144 having a translation gear 146 engaged with translation gear 58 of second leg assembly 24 and translation gear 126 of first end upper rotational support 122 and a second end 148 having a translation gear 150 engaged with translation gear 58 of third leg assembly 26 and translation gear 136 of the second end upper rotational support 132.

Figure 3A:
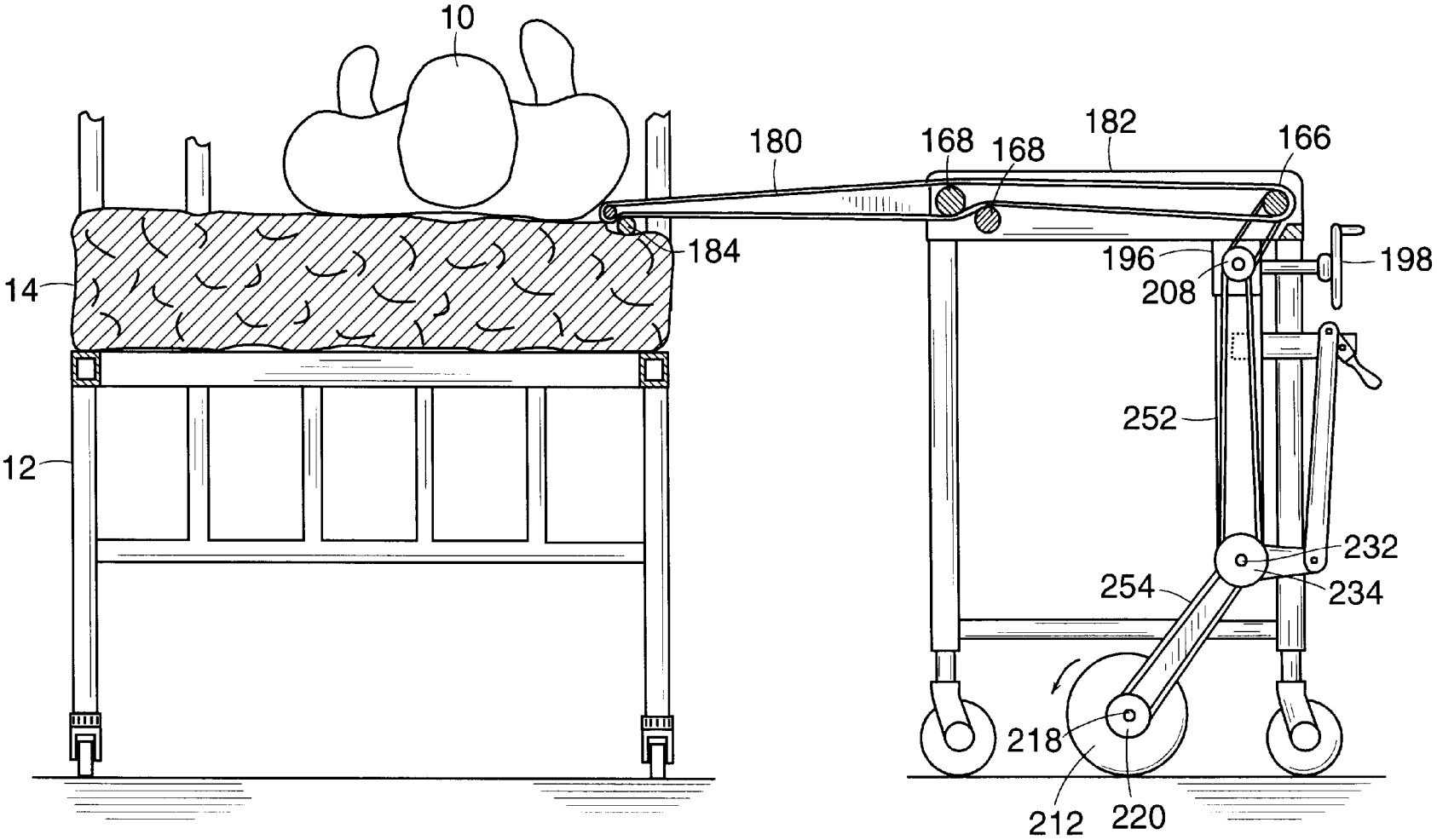
FIG. 3A is a side elevation view of the patient transportation device of the first embodiment present invention just prior to engagement with a conventional hospital bed.
Figure 3B:
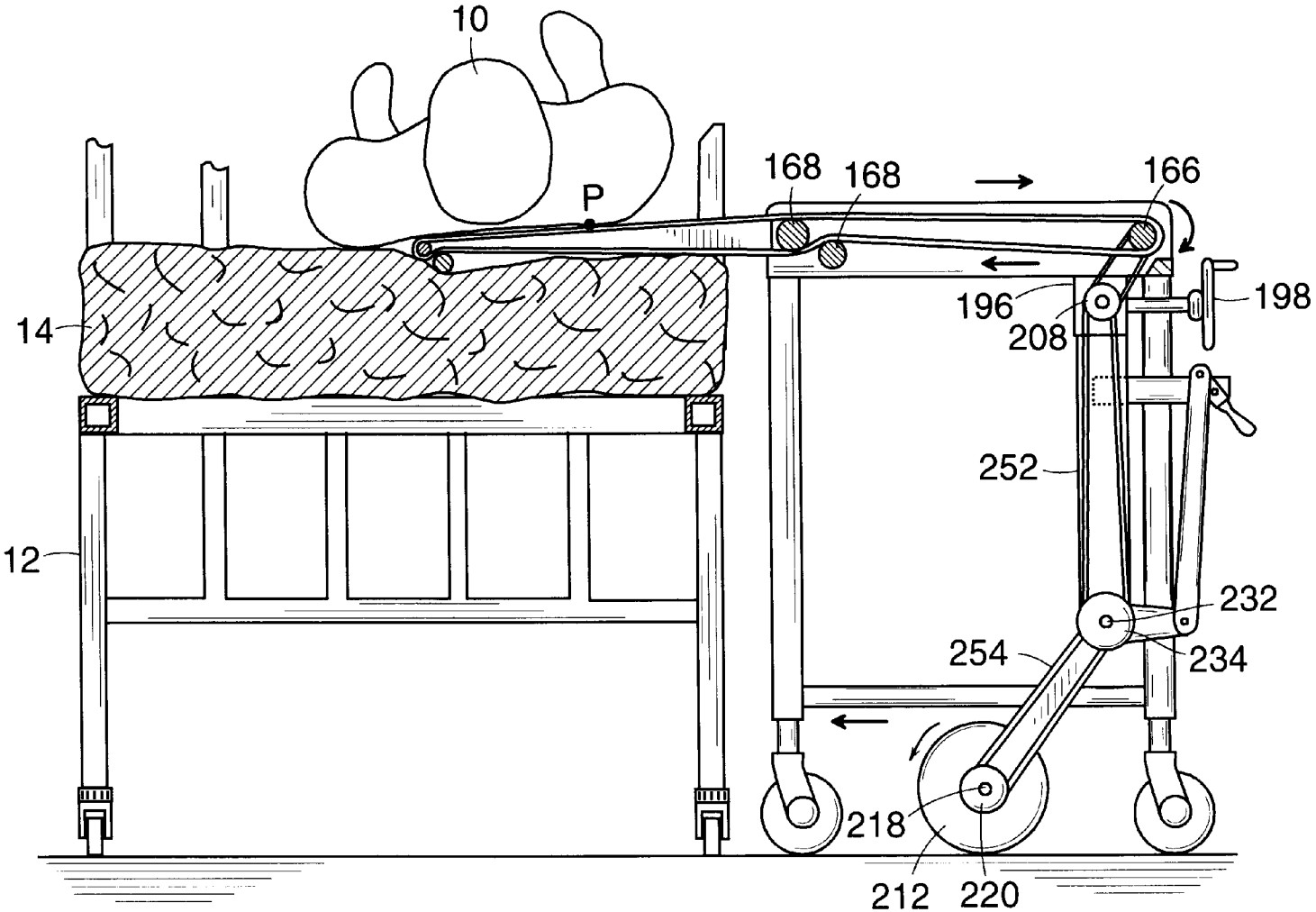
FIG. 3B is a side elevation view of the patient transportation device of the first embodiment present invention engaged with a conventional hospital bed.
Figure 4:
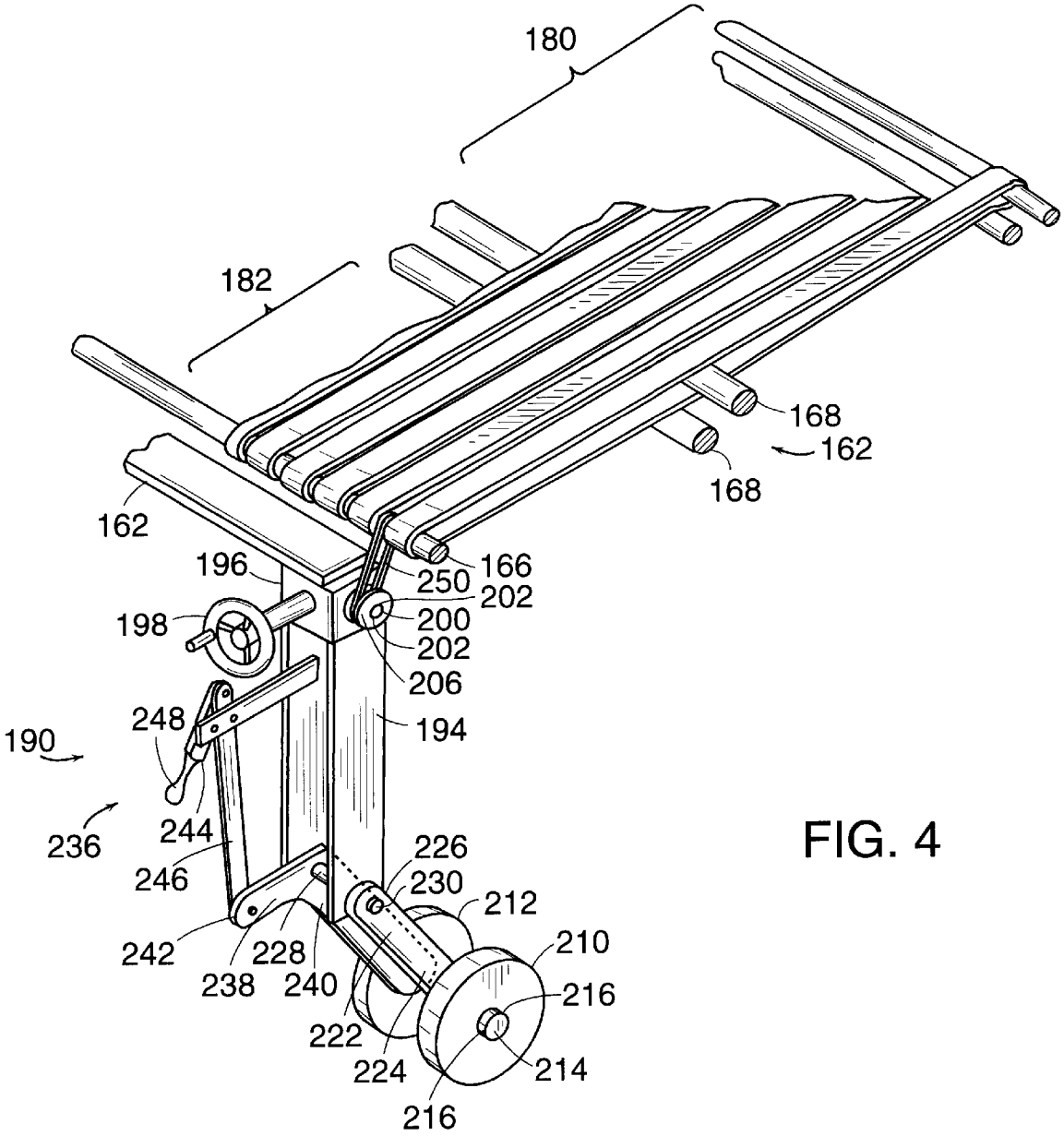
FIG. 4 is an exploded perspective view of the drive mechanism of the patient transportation device of the first embodiment.

Referring to FIGS. 1, 3 and 3B, the device 16 further comprises an upper support frame 162 comprising a frame 164, a front roller 166, a rear roller 168 and an extension member 170. The extension member 170 comprises an end portion 184 having an upper roller 174 and a lower roller 176 disposed therein.

The device 16 further comprises a plurality of belts 178. Each of belts 178 are engaged with front roller 166, rear roller 168, and upper and lower rollers 174 and 76 to define a patient transfer portion 180 located between the first end portion 184 of extension member 170 and rear roller 168 and a patient transport portion 182 located between the front and rear rollers 166 and 168.

The device 16 further comprises a height adjustment mechanism 186 which is adapted to allow the technician to raise the height of the leg assemblies 20, 22, 24 and 26 of the lower support frame 18 which thereby raises the height of the upper support fame 162. Height adjustment mechanism 186 generally comprises a gear box 188 and a crank wheel 190 engaged with the first end upper rotational support 122. Rotation of crank wheel 190 causes rotation of the fist end upper rotational support 122 which in turn causes rotation of the side upper rotational support 152 which in turn causes rotation of the second end upper rotational support 132. Rotation of the side support 152 and first and second end supports 122 and 132 causes rotation of the external male screw drive member 40 of the leg assemblies 20, 22, 24 and 26 thereby raising and/or lowering of the leg assemblies 20, 22, 24 and 26.

The device 10 further comprises a drive mechanism 190 which generally provides lateral movement of the device 16 to and from a hospital bed 14 and to provide movement of the belts 178. The drive mechanism 190 generally comprises a stationary bracket 194 connected to the upper support frame 162. The drive mechanism 190 further comprises a gear box 196 having an input shaft (not shown) and an output shaft 200 having a first end portion 202 and a second end portion 204. The drive mechanism 190 further comprises a crank wheel 198 connected to the input shaft (not shown) of the gear box 196 and which may rotated by the technician as desired. The drive mechanism 190 further comprises a first pulley 206 disposed at the first end portion 202 and a second pulley 208 disposed at the second end portion 204. The drive mechanism 190 further comprises a first and second drive wheel 210 and 212 securely mounted about a first axle 214 having first and second end portions 216 and 218. The drive mechanism 190 further comprises a third pulley 220 disposed about the second end portion 218 and adjacent the second drive wheel 212. The drive mechanism 190 further comprises a moveable bracket 222 having a first end portion 224 connected to the first axle 212 and a second end portion 226 rotatably connected about a second axle 228 to the stationary bracket 194. The second axle 228 has a first end portion 230 and a second end portion 232. The drive mechanism 190 further comprises a fourth pulley 234 securely connected to the first end portion 230 of second axle 228 and above the third pulley 220.

The drive mechanism 190 further comprises a wheel engagement mechanism 236 which is adapted to allow the technician to engage and disengage the drive wheels 210 and 212 210 from the floor. The wheel engagement mechanism 236 generally comprises a cam 238 having first and second end portion 240 and 242, and a lever 244 having first and second end portions 246 and 248. The first end portion 240 of the cam 238 is connected to the second axle member 228. The second end portion 242 of the cam 238 is connected to the first end portion 246 of the lever. The second end portion 248 of the lever 244 may be moved upward and/or downward by technician which causes the cam 238 to rotate clockwise and/or counter-clockwise, which in turn causes the second axle 228 carrying the first and second drive wheels 210 and 210 to be engaged with the floor and/or disengaged from the floor.

The drive mechanism 190 further comprises a first belt 250, a second belt 252, and a third belt 254. First 250 is engaged with the first pulley 206 and the front roller 166 of the upper support frame 162. Second belt 252 is engaged with the second pulley 208 and the fourth pulley 234. Third belt 254 is engaged with the third pulley 220 and the fourth pulley 234.

The device 16 further comprises a safety frame 256 which may be disposed about the upper support frame 162 to prevent the patient from falling off the device 10.

Figure 5:
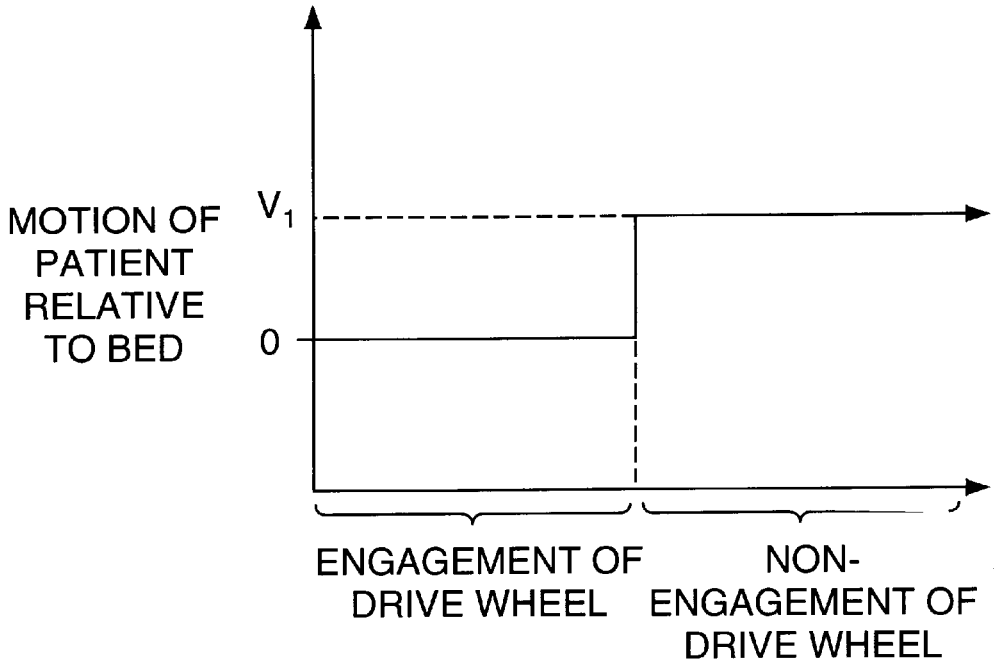
FIG. 5 is a graph showing zero motion of the patient relative to the hospital bed when the drive wheel is engaged and motion of the patient relative to the hospital bed.
Figure 6:
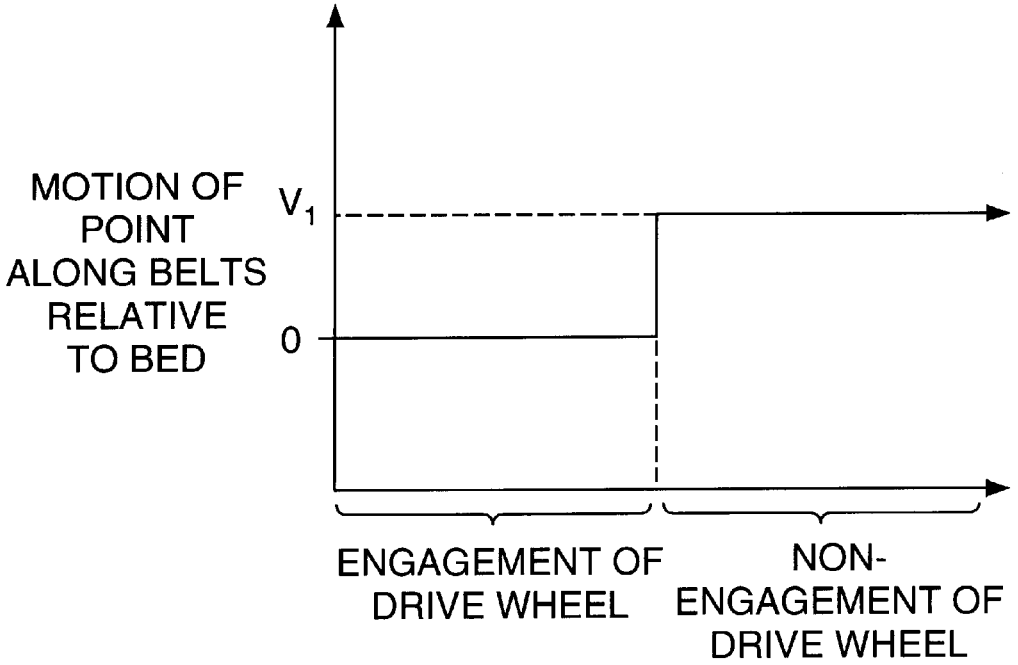
FIG. 6 is a graph showing zero motion of any point along the belts of the patient transfer portion relative to the hospital bed when the drive wheel is engaged.

As shown in FIGS. 3A and 3B and by FIGS. 5 and 6, with the device 16 of the present invention, because of the opposite motions of the belts 178 and the drive wheels 210 and 212, there is substantially zero or absolutely zero relative motion between the patient and the hospital bed 10. The end portion 184 of the extension member 170 is moved (or the belts 178 are rolled) under the patient 10 without any sliding or friction. This is accomplished by selecting different gear reductions ratios so that the output to the drive wheels 210 and 212 and to the belts 178 of the extension member 170 are timed so that the motion of one offsets the motion of the other (i.e., the translational speed or velocity that the device 12 is moving at due to rotation of drive wheels 210 and 212 is the same or substantially the same as the translational speed or velocity of the belts 178). Throughout the transfer process, the patient is never slid, lifted or otherwise physically invaded, thereby reducing any injury to the patient and/or to the person transferring the patient to and/or from a hospital bed.

With the device 10 of the present invention, a nurse can manually control the rotation of the drive wheels 210 and 212 and therefore movement of the device 16 and the of belts 178 thereby providing the person with direct sensory feedback thereby further reducing any sliding, lifting or otherwise physical force to the patient during the transfer process thereby further reducing any injury to the patient and/or to the person transferring the patient to and/or from a hospital bed.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for use by a person to transport a patient from a hospital bed, the device comprises:

(a) a support frame comprising a plurality of wheels adapted to roll upon the floor;

(b) a patient transfer portion engaged with and extending outward of said support frame and comprising a plurality of belts;

(c) a patient transport portion engaged with said support frame and comprising a plurality of belts;

(d) a drive wheel engaged with said support frame;

(e) a drive mechanism engaged with said support frame, said drive mechanism comprising a manual crank wheel, said drive mechanism being adapted so that rotation of said manual crank wheel causes said drive wheel to rotate and to move said support frame in a first direction and at a first velocity and to move said belts of said patient transfer portion and said patient transport portion in a second direction and at a second velocity, said first direction being substantially opposite to said second direction, said first velocity and said second velocity being substantially the same; and (f) upon engagement of said drive wheel and rotation of said crank wheel by the person said patient transfer portion may be moved under the patient and upon disengagement of said drive wheel and rotation of said crank wheel the patient is moved from said patient transfer portion to said patient transport portion.

2. The device of claim 1, wherein said drive mechanism comprises a gear box connected to said support frame, said gear box having an input shaft and an output shaft, said output shaft being engaged with said drive wheel and said belts of said patient transfer portion and said patient transport portion, and said manual crank wheel is engaged with said input side of said gear box.

3. The device of claim 2, wherein said belts of said patient transfer portion are engaged with said belts of said patient transport portion.

4. The device of claim 3, wherein said patient transport portion comprises a drive roller and a first bearing roller, said belts of said patient transport portion being moveably engaged with said drive roller and said first bearing roller.

5. The device of claim 4, wherein said patient transfer portion comprises comprise a patient engagement end having second and third bearing rollers and a forth bearing roller, said belts of said patient transfer portion being moveably engaged with said second, said third, and said fourth bearing rollers.

6. The device of claim 5, wherein said drive mechanism further comprises a shaft engaged with said output side of said gear box, said shaft having a first end portion and a second end portion.

7. The device, of claim 6, wherein said drive mechanism further comprises a first pulley disposed at said first end portion of said shaft and a second pulley disposed at said second end portion of said shaft.

8. The device of claim 7, wherein said drive mechanism further a first axle member about which said drive wheel is rotatably mounted.

9. The device of claim 8, wherein said drive mechanism further comprises a moveable bracket member having a first end portion and a second end portion, said first end portion is rotatably connected to said stationary bracket by a second axle member and second end portion is connected to said first axle member.

10. The device of claim 9, wherein said drive mechanism further comprises a third pulley disposed at said first end portion of said first axle member.

11. The device of claim 10, said drive mechanism further comprises a fourth pulley disposed about said first end portion of said second axle member.

12. The device of claim 11, wherein said drive mechanism further comprises a first belt engaging said first pulley and said front roller of said upper support frame.

13. The device of claim 12, wherein said drive mechanism further comprises a second belt engaging said second pulley and said third pulley.

14. The device of claim 13, wherein said drive mechanism further comprises a third belt engaging said third pulley and said fourth pulley.

15. The device of claim 14, wherein said drive mechanism further comprises a wheel engagement mechanism adapted to engage and disengage said drive wheel with the floor.

16. The device of claim 15, wherein said wheel engagement mechanism comprises a cam member and a lever, said cam member having first and second portions, said lever having first and second portions, said first portion of said cam being connect to said second axle member, said second portion of said cam being connected to said first portion of said lever, said second portion of said lever being moveable by the person.

* * * * *